US007429180B1

(12) United States Patent
Gostling

(10) Patent No.: US 7,429,180 B1
(45) Date of Patent: Sep. 30, 2008

(54) METHOD AND APPARATUS FOR RESTRICTING ELECTRICAL CONNECTION TO A CONTACT IN AN ELECTRICAL CONNECTOR

(75) Inventor: Edward M. Gostling, Longmont, CO (US)

(73) Assignee: Maxtor Corporation, Scotts Valley, CA (US)

( * ) Notice: Subject to any disclaimer, the term of this patent is extended or adjusted under 35 U.S.C. 154(b) by 685 days.

(21) Appl. No.: 10/406,758

(22) Filed: Apr. 2, 2003

Related U.S. Application Data

(60) Provisional application No. 60/371,136, filed on Apr. 8, 2002.

(51) Int. Cl.
*H01R 13/44* (2006.01)

(52) U.S. Cl. ..... 439/134

(58) Field of Classification Search ..... 439/186, 439/149, 150, 510, 639, 521, 146, 134, 148; 174/138 F, 74 A; 13/156
See application file for complete search history.

(56) References Cited

U.S. PATENT DOCUMENTS 2,538,483 A * 1/1951 Summers ..... 411/374
3,407,264 A * 10/1968 Cull ..... 174/138 F
3,441,661 A * 4/1969 Brummans ..... 174/138 F
5,281,165 A * 1/1994 McCleerey et al. ..... 439/510

* cited by examiner

*Primary Examiner*—Ross N Gushi
(74) *Attorney, Agent, or Firm*—Leanne Taveggi Farrell; Westman,, Champlin & Kelly, P.A.

(57) ABSTRACT

A method and apparatus are disclosed for restricting electrical connection to an electrical contact in a hard disk drive. A hard disk drive is provided which includes an electrical interface having a plurality of electrical contacts, and a restricting member. Access to at least one of the electrical contacts is restricted through the restricting member such that an electrical connection between the restricted contact and another electrical contact is avoided. The restricting member may be a shroud associated with the restricted electrical contact. The shroud includes an access passage which allows for an electrical connection between the restricted electrical contact and a contact on a self test rack. The shroud also prevents a shorting jumper from being placed on the restricted electrical contact, thus reducing the possibility of an inadvertent electrical connection between the restricted electrical contact and another electrical contact.

57 Claims, 11 Drawing Sheets

METHOD AND APPARATUS FOR RESTRICTING ELECTRICAL CONNECTION TO A CONTACT IN AN ELECTRICAL CONNECTOR

CROSS REFERENCE TO RELATED APPLICATIONS

Priority is claimed from U.S. Provisional Patent Application Ser. No. 60/371,136 filed Apr. 8, 2002 entitled "Connector Restricted Pin Access" which is incorporated by reference herein in its entirety.

FIELD OF THE INVENTION

The present invention related to electrical connectors, and, more particularly, to a method and apparatus for restricting electrical connection to a contact in an electrical connector in a hard disk drive.

BACKGROUND OF THE INVENTION

As is well known in the art, hard disk drives are data storage devices that typically employ magnetic or optical media to store data. The media is traditionally one or more disks, which contain concentric tracks that are capable of storing data. The disk drive contains a read/write head for each disk surface, and the read/write head is positioned over a particular track in order to read and/or write data to the track. The disk drive positions the read/write head over the appropriate track using servo information which is contained in the tracks. Servo reading is done with one read/write head at a time, while servo writing may be done with multiple read/write heads simultaneously. Each data track contains servo information in multiple locations to aid in the positioning of the read/write heads when reading/writing customer data.

Conventionally, in the context of magnetic media, servo information is written to the storage media using a servo track writer. As will be understood, a servo track writer is an expensive piece of capital equipment. The servo track writer includes hardware which is able to finely position the read/write heads in the disk drive and write servo track information to the magnetic media. Even though a dedicated servo track writer writes servo information to multiple disk surfaces simultaneously, the process of servo track writing can be relatively time consuming, since the magnetic media typically contain many thousands of data tracks each of which contain servo information written in multiple locations. However, because of their expense, disk drive manufacturers rely on as few servo track writers as possible to operate a manufacturing facility.

As will be understood, in manufacturing operations it is highly desirable to reduce manufacturing times and capital expenditures, in order to reduce the total cost of the hard disk drive. In order to help reduce the amount of capital equipment required for disk drive manufacture, and to help reduce manufacturing time, some manufacturers have begun using the disk drive itself to write servo track information, without requiring, or reducing the use of a dedicated servo track writer. Such a process is referred to herein as a self servo write (SSW) operation. While SSW can help reduce the number of servo track writers required in a manufacturing operation, thereby reducing cost, problems can result.

For example, as mentioned above, it is common for disk drives to contain more than one magnetic disk, with many designs including four (4) disks, resulting in eight (8) surfaces which are capable of storing data. Thus, eight read/write heads are present in such a disk drive. Moreover, the power supply used to operate the read/write heads during normal operation is designed only to supply enough power for one read/write head to operate at any given time. This creates a power supply problem when performing SSW, as it is beneficial and preferable to operate all of the read/write heads simultaneously to write servo information on each surface simultaneously, in order to minimize the amount of time required for SSW. Furthermore, it is common to write servo information in partial data track steps, thus requiring multiple passes to completely write the servo information for a data track. Thus, performing such a SSW operation can take a significant amount of time if it is accomplished one disk surface at a time. One way to reduce the amount of time required for SSW operations is to provide the disk drive with a higher capacity power supply capable of supplying enough power to operate all of the read/write heads simultaneously. This supply could be internal to the disk drive, and be included on each drive that is shipped. However, the added power is only required in the factory during the SSW operation to write multiple surface servo information, and not during normal customer data operations. Thus, a larger on board power supply would add a significant amount of cost to the disk drive, ultimately increasing the cost of the disk drive for the customer. Thus, it would be beneficial to perform a SSW operation using more than one read/write head simultaneously in the factory, while still providing the hard disk drive with a power supply optimized for a customer's use to operate one read/write head at a time.

One method which may be used to perform SSW with more than one read/write head simultaneously is to provide the disk drive access to an external power supply, which remains in the factory and does not ship on each drive. The disk drive manufacturer may use the external supply to power multiple read/write heads during SSW operations. The smallest adequate power supply on-board the disk drive to read and write with only one head is delivered to the customer, allowing the customer to pay only for the capability they need. The cost savings to the customer results from a reduced bill of materials and the reduced use of factory capital equipment. However, a problem arises in such a situation related to access to the external power supply. More specifically, providing an access point for the external power supply to connect to the disk drive may result in an unintended electrical connection between adjacent contacts which, in turn, may cause significant damage to the disk drive.

Typically, when manufacturing a hard disk drive, the components of the disk drive are assembled into a casting, which results in two available surfaces which may be used to provide an external electrical connection, namely, the back edge and the top. Furthermore, during manufacture, it is generally beneficial to place disk drives in racks when doing testing and servo track writing operations, thus leaving the back edge as the most convenient surface to use as the electrical connection to the external power supply. The back edge of disk drives generally contain electrical connections, which are contained in an edge-to-edge connector or interface, commonly known as a three-in-one connector. Such a three-in-one connector is widely used and incorporates an advanced technology attachment (ATA) connector recommended standard.

One form of a three-in-one connector is illustrated in FIG. 1. The three-in-one connector 20 contains contacts in three different areas. The three-in-one connector 20 contains power contacts 24, jumper contacts 28, and logic contacts 32. The power contacts 24 include contacts which connect to a power output from a power supply associated with the equipment in which the hard disk drive is installed, such as a personal computer. The jumper contacts 28 typically include contacts to components within the hard disk drive. A shorting jumper may be used to short two adjacent contacts together, and enable or disable certain features within the disk drive, such as master or slave operation. The logic contacts 32 include contacts which are operable to transmit data to and from the disk drive for storage and retrieval. The power contacts 24 and the logic contacts 32 have a standardized configuration, leaving the jumper contacts 28 as a logical location for the connection to the external power supply. The jumper contacts are defined and commonly used by manufactures to customize disk drive operation. However, since the jumper contacts 28 provide an electrical connection to components within the hard disk drive, if a contact for the external power supply is connected to another contact within the jumper contacts 28, severe damage to the components of the disk drive may result. Thus, it would be beneficial to have a contact for providing necessary power for performing a SSW operation, while also protecting the disk drive from damage which may result from an unintentional electrical connection between the power contact and another contact.

While the above-description is directed toward disk drives, it will be understood by those of skill in the art that similar problems exist in other industries. For example, certain computer components, such as, for example, a component containing an electronic erasable programmable read only memory (EEPROM), may require a voltage or current to be applied during manufacture that is not required for normal device operation by a customer. Thus, the present invention has broader applicability than disk devices and could be used with, for example, a portable electronic device which may include an EEPROM which is programmed with the operating system for the device. The EEPROM is programmed using a programming voltage which is greater than the normal operating voltage for the device. Accordingly, it would be advantageous to have a contact for providing necessary power for programming the device, while also protecting the device from an unintentional electrical connection between the power contact and another contact, which may cause damage to the device.

Accordingly, it would be advantageous to have a hard disk drive capable of performing a SSW operation using more than one read/write head simultaneously. It would be beneficial for the manufacturer to simultaneously write servo information for two or more read/write heads (known as a stagger write), or all read/write heads simultaneously (known as a full bank write). It would also be advantageous for such a disk drive to have a power supply optimized for normal operation of the read/write heads that use one read/write head at a time, thus helping to reduce the cost of the disk drive. Furthermore, it would be advantageous for such a disk drive device such as an optical drive or portable electronic device to have an electrical contact for connection to a temporary external power supply which has a relatively small likelihood of inadvertent contact with other electrical contacts to minimize potential damage to the disk drive or other electrical component.

SUMMARY OF THE INVENTION

The present invention solves the aforementioned problems and meets the aforementioned, and other, needs.

In one embodiment, the invention provides a method and apparatus for restricting electrical connection to an electrical contact in a hard disk drive. The invention provides a hard disk drive which includes an electrical interface having a plurality of electrical contacts, and a restricting member. Access to at least one of the electrical contacts is restricted through the restricting member such that the possibility of an electrical connection between the restricted contact and another electrical contact is substantially reduced or avoided.

In one embodiment, the restricting member is a shroud associated with the restricted electrical contact. The shroud includes an access passage which allows for an electrical connection between the restricted electrical contact and a contact on a self test rack. The shroud also prevents, or at least minimizes the possibility of, a shorting jumper from being placed on the restricted electrical contact, thus reducing the possibility of an inadvertent electrical connection between the restricted electrical contact and another electrical contact. The shroud may be integrated into a connector plate associated with the electrical interface, or may be placed on the restricted electrical contact during manufacture.

A cap may also be placed over the electrical contact to serve as the restricting member.

Additional features and other embodiments of the present invention will become apparent from the following discussion, particularly when taken together with the accompanying drawings.

DETAILED DESCRIPTION

Figure 1:
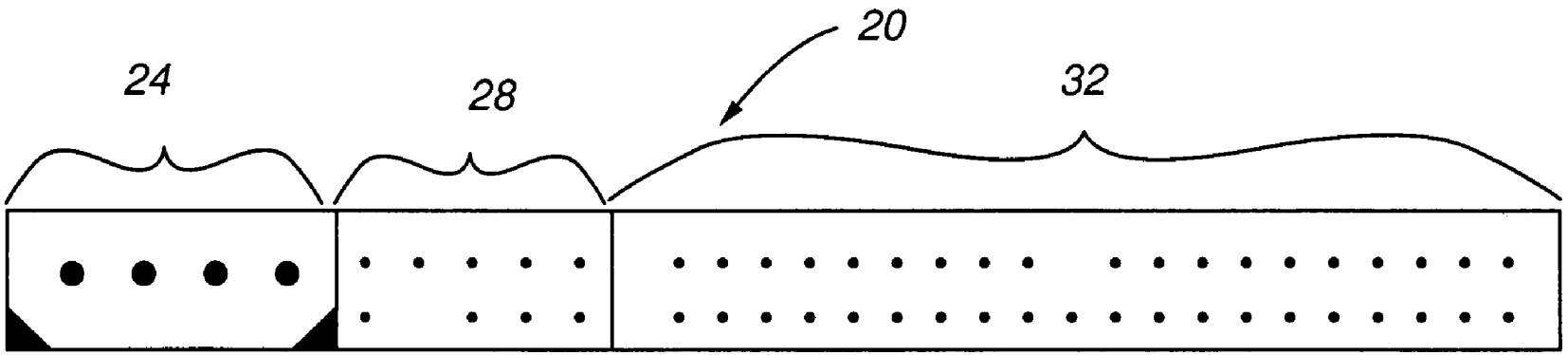
Fig. 1 (PRIOR ART)
FIG. 1 is an illustration of a prior art three-in-one connector for a hard disk drive.
Figure 2:
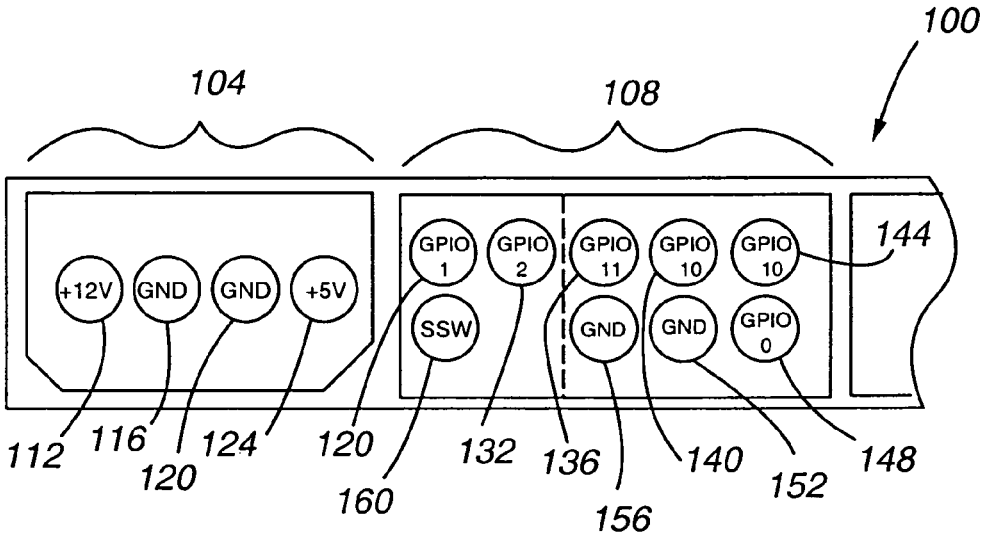
FIG. 2 is an illustration of a portion of an electrical connecter for a disk drive for one embodiment of the present invention.

The present invention provides an electrical connector for a disk drive which includes contacts for power, logic, and jumper connections. FIG. 2 is an illustration a portion of a connector 100 of one embodiment of the present invention illustrating the power contacts 104, and the jumper contacts 108. Within the power contacts 104 there is a +12V contact 112, a first ground contact 116, a second ground contact 120, and a +5V contact 124. Within the jumper contacts 108, there is a GPIO-1 contact 128, a GPIO-2 contact 132, a GPIO-11 contact 136, a first GPIO-10 contact 140, a second GPIO-10 contact 144, a GPIO-0 contact 148, a first ground contact 152, a second ground contact 156, and a self servo write (SSW) contact 160. The SSW contact 160, in this embodiment, provides a contact for a minus 5V supply for use while performing a self servo write operation, as discussed above, using more than a single read/write head within the disk drive. Other voltages are also possible, with minus 5V being the voltage for this embodiment. Providing the SSW contact 160 enables the disk drive to perform the self servo write operation during manufacture by, for example, placing the disk drive in a test rack with the test rack having contacts to provide minus 5V to the SSW contact 160. In this embodiment, the self test rack also may have contacts to connect to the GPIO-1 contact 128 and the GPIO-2 contact 132, which send and receive data related to the self servo write operation. In one embodiment, the GPIO-1 contact 128 operates to receive servo write information from the self test rack, and the GPIO-2 contact 132 operates to transmit servo write information to the self test rack.

Figure 3:
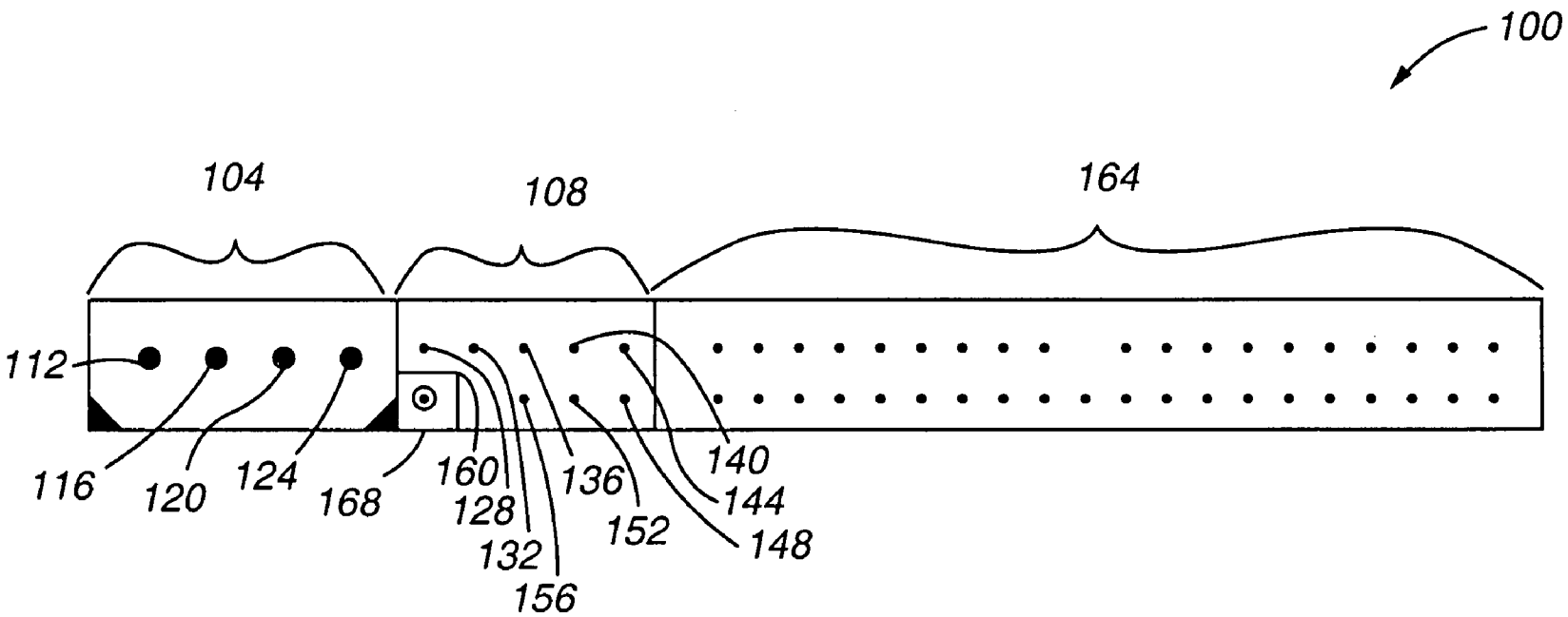
FIG. 3 is an illustration of an electrical connector having a restriction portion for one embodiment of the present invention.

As previously discussed, when placing a minus 5V contact in the jumper contacts, making an electrical connection between this minus 5V contact and another jumper contact may result in damage to the electrical components within the disk drive. Such damage may result in the drive no longer being functional. In order to help insure that contact is not made between the minus 5V contact and another jumper contact, a physical change is made to the disk drive. Such a physical change is illustrated, for one embodiment of the present invention, in FIG. 3. The disk drive connector, or interface, 100 of FIG. 3 includes a molded in shroud 168, which provides restricted access to the SSW contact 160. While the embodiment of FIG. 3 has a shroud which is molded into the plastic which surrounds the electrical interface, and acts as an insulation around the SSW contact 160, other devices for restricting access to the SSW contact 160 may also be used which are not molded into the plastic, such as, for example, a bead which is placed onto the contact at the manufacturing facility. Such a bead may be held in place around the SSW contact 160 by mechanical interference (force fit), or an adhesive. The shroud 168 restricts access by preventing a customer from placing a shorting jumper across the SSW contact 160 which would electrically connect the SSW contact 160 with, for example, the GPIO-1 contact 128. By restricting access to the SSW contact 160 in such a way, the chances are significantly reduced that any electrical contact between the SSW contact 160, and any of the other contacts in the jumper contacts area 108 will be made. In addition to providing a physical restriction to the SSW contact 160, the shroud 168 also provides a visual indication that the contact should not be connected to any other contacts. In one embodiment, the shroud 168 is a different color, thus providing additional visual indication that the SSW contact 160 should not be connected to another contact.

Figure 4:
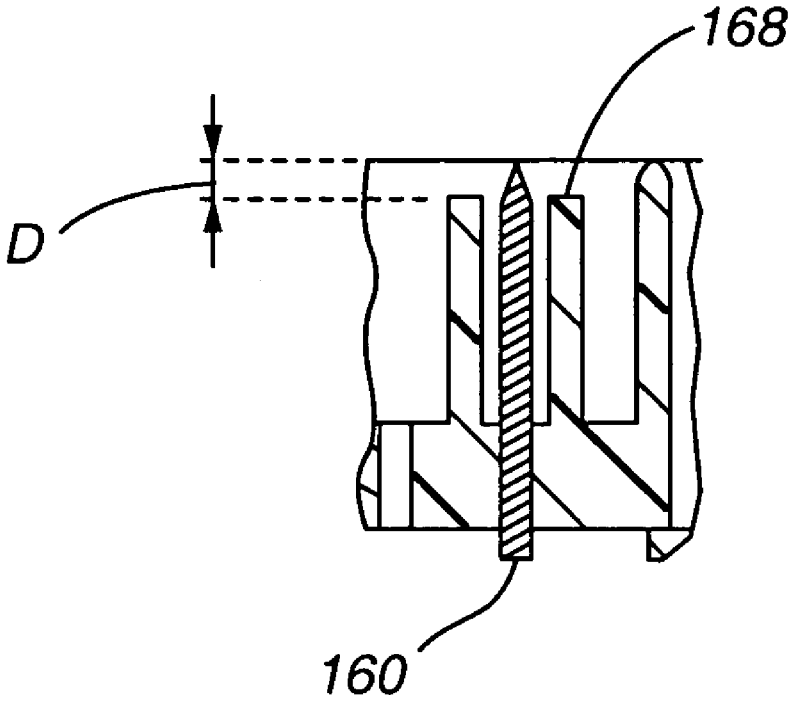
FIG. 4 is a cross-sectional illustration of a SSW contact and an associated shroud for one embodiment of the present invention.
Figure 5:
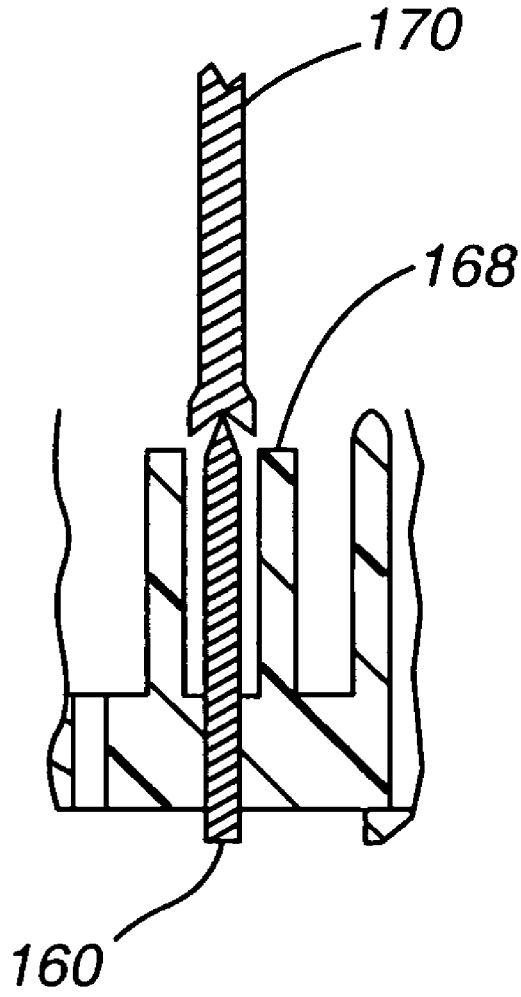
FIG. 5 is a cross-sectional illustration of the SSW contact of FIG. 4 and an associated pogo pin contact for one embodiment of the present invention.

Referring now to FIG. 4, a cross-sectional illustration of a SSW contact 160 and associated shroud 168 for one embodiment is now discussed. In this embodiment, the shroud 168 is configured such that the SSW contact 160 extends beyond the end of the shroud 168 by a distance D. This extension of the SSW contact 160 enables a "pogo pin" contact from a test rack to contact the SSW contact 160 relatively easily. A pogo pin contact is a contact which is associated with the test rack, and contains a mechanism which allows the contact to telescope with respect to the test rack, such that when a disk drive is inserted into the test rack the pogo pin contact contacts the appropriate electrical contact on the disk drive and maintains pressure on the electrical contact during testing operations. As illustrated in FIG. 4, the end of the SSW contact 160 extends beyond the end of the shroud 168, thus allowing a pogo pin to have a relatively flat or slightly concave surface which contacts the SSW contact 160. Other pogo pin surfaces are possible, so long as a reliable contact may be made to the SSW contact 160. FIG. 5 illustrates a connection between a pogo pin 170, and the SSW contact 160 of FIG. 4.

Figure 6:
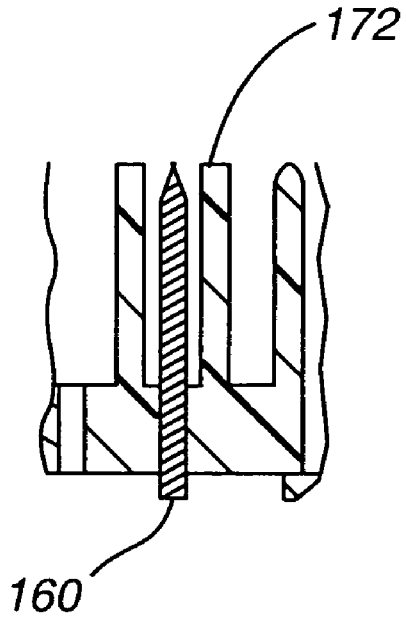
FIG. 6 is a cross-sectional illustration of a SSW contact and associated shroud for one embodiment of the present invention.
Figure 7:
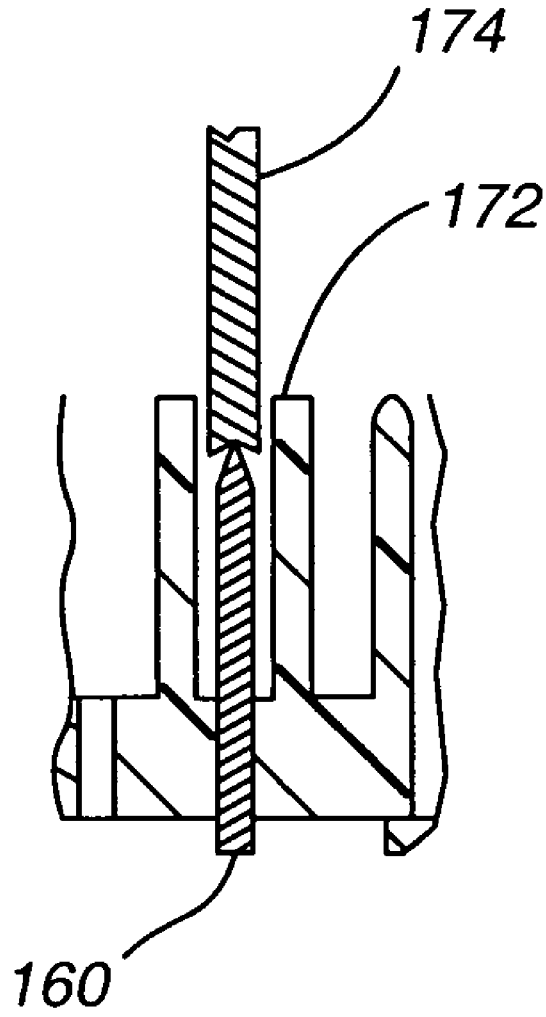
FIG. 7 is a cross-sectional illustration of the SSW contact of FIG. 6 and an associated pogo pin contact for one embodiment of the present invention.

In another embodiment, illustrated in FIG. 6, a shroud 172 extends beyond the end of the SSW contact 160. In this embodiment, the test rack would be configured with a pogo pin which is operable to extend into the opening in the shroud 172 and contact the SSW contact 160. FIG. 7 illustrates a connection between such a pogo pin 174 and the SSW contact 160. This embodiment further reduces potential contact with the SSW contact 160 and other jumper contacts, although it requires tighter tolerances for the placement of the disk drive into the test rack to insure the pogo pin 174 from the test rack enters the opening in the shroud 172.

Figure 8:
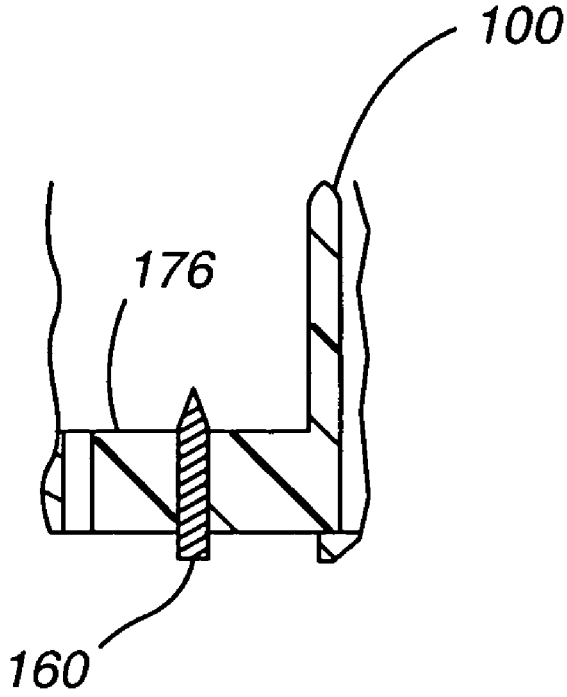
FIG. 8 is a cross-sectional illustration of a SSW contact for one embodiment of the present invention.
Figure 9:
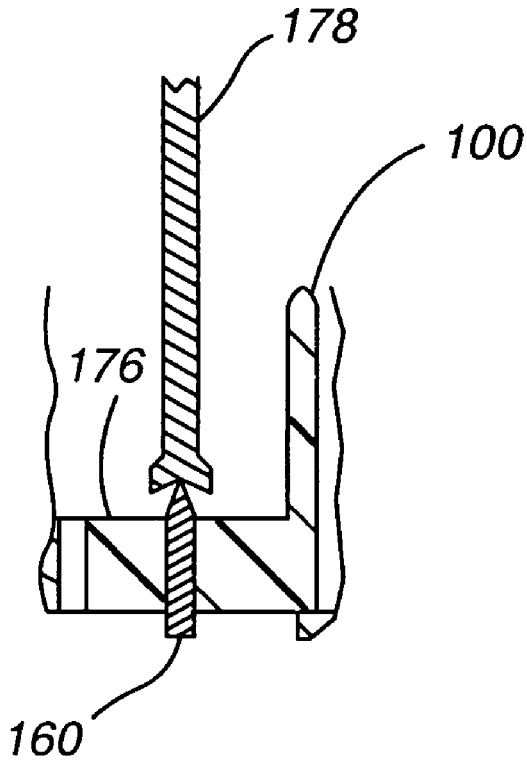
FIG. 9 is a cross-sectional illustration of the SSW contact of FIG. 8 and an associated pogo pin contact for one embodiment of the present invention.

In another embodiment, illustrated in FIG. 8, the SSW contact 160 is manufactured such that it extends only a short distance beyond the base plate 176 of the plastic connector 100. This configuration is referred to as a "runt pin" configuration. In this embodiment, even though no shroud is utilized, the likelihood of contact between the SSW contact 160 and other contacts is reduced because a shorting jumper is not able to be placed on the SSW contact due to its reduced height. Thus, even if a shorting jumper was attempted to be placed on an adjacent contact to the runt pin SSW contact 160, the reduced height of the runt pin minimizes the likelihood of an unintended contact between it and another contact. In this embodiment, as illustrated in FIG. 9, the pogo pin contact 178 in the test rack is configured such that it extends to contact the runt pin on the disk drive, enabling contact to be made between the pogo pin contact 178 and the SSW contact 160.

Figure 10:
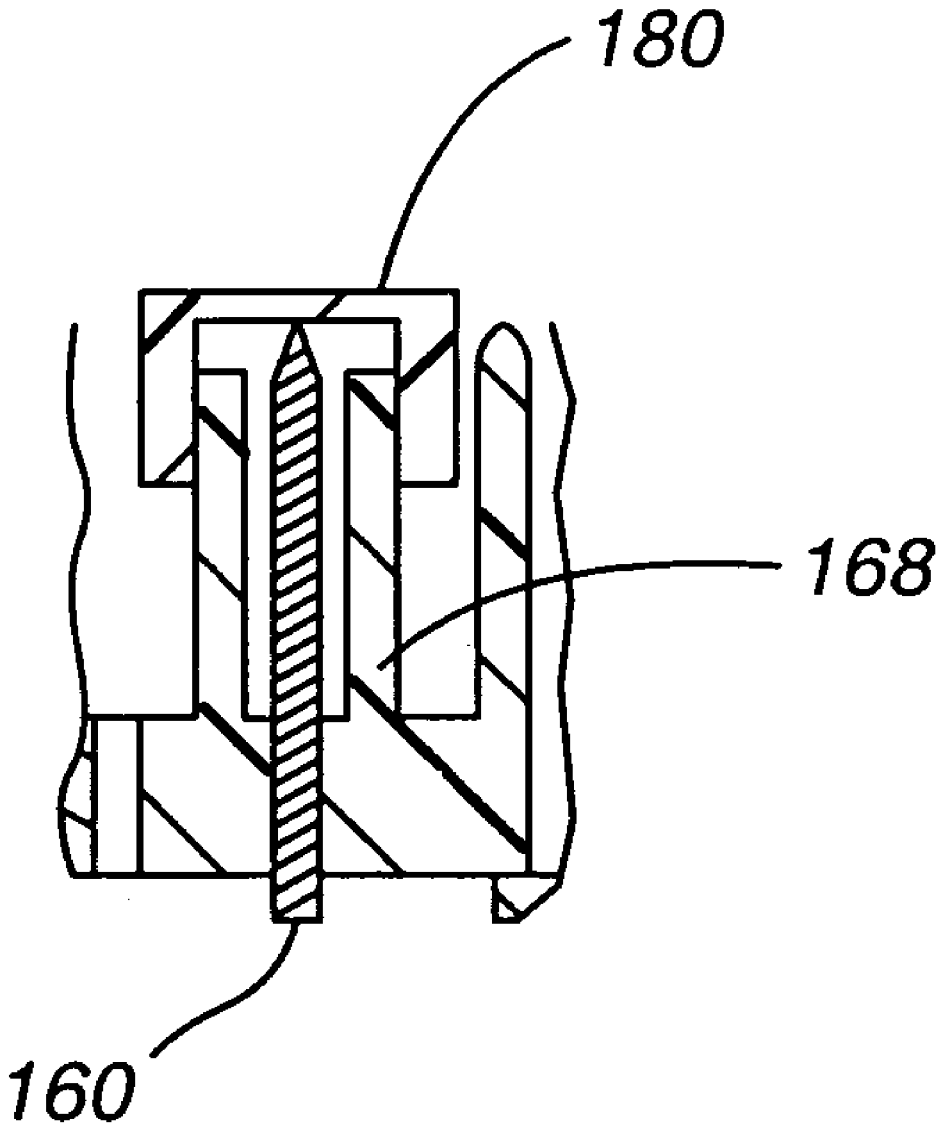
FIG. 10 is a cross-sectional illustration of a SSW contact and an associated shroud and cap for one embodiment of the present invention.

In another embodiment, illustrated in FIG. 10, a cap 180 is also used to restrict access to the SSW contact 160. In this embodiment, the cap 180 is placed over the shroud 168 to completely insulate the SSW contact 160. The cap 180 may be held in place by mechanical interference (force fit), by an adhesive, or by thermal shrinking of the cap after it is placed over the shroud. Thus, the possibility of inadvertent contact to the SSW contact 160 is further reduced. In the embodiment illustrated in FIG. 10, the cap 180 is placed over the shroud 168, however it will be understood that other configurations of a cap may be used, such as a cap which blocks any access to the SSW contact 160 through the shroud 168, as well as a cap that is placed over the SSW contact 160 without a shroud 168 being present at all.

Figure 11:
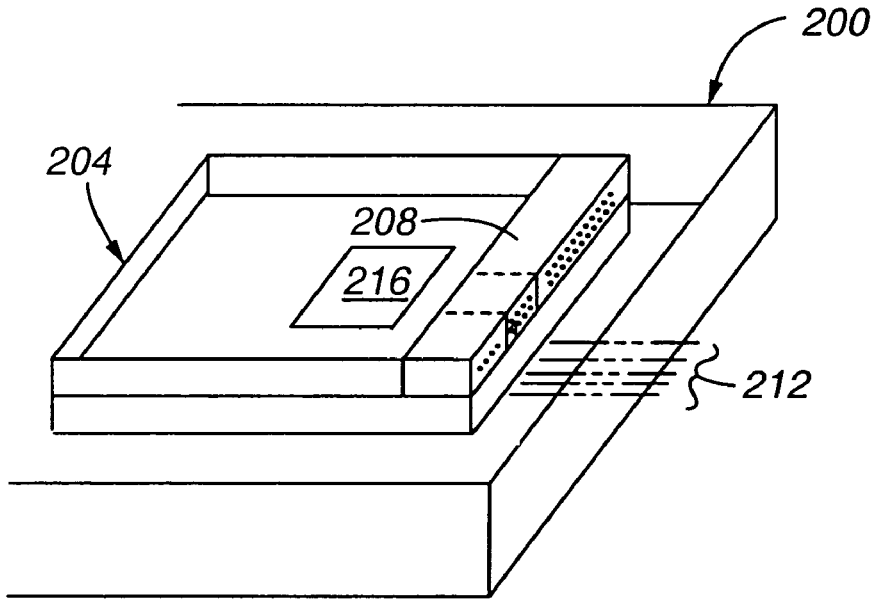
FIG. 11 is a perspective illustration of a hard disk drive and a test rack slot for one embodiment of the present invention.

Referring now to FIG. 11, a perspective illustration of a test rack slot 200 with respect to a hard disk drive 204 is now described for one embodiment of the present invention. In this embodiment, a hard disk drive 204 is inserted into the test rack slot 200. As will be understood, there are typically a relatively large number of test rack slots 200 in a test rack for a disk drive manufacturing facility, in order to simultaneously test a large number of disk drives 204. Since the test racks hold many test rack slots 200, it is convenient and practical to have electrical contacts between the test rack slot 200 and the hard disk drive 204 only at the rear of the hard disk drive 204, at the 3-in-1 connector 208 for the disk drive 204. This contact point allows multiple test rack slots 200, and thus multiple hard disk drives 204, to be stacked relative to one another in order to make efficient use of available space. The disk drives 204 may then be slid into and out of the test rack slots 200. To facilitate the electrical connections to the electrical contacts in the 3-in-1 connector 208, the test rack slot 200 contains a number of pogo pins 212. As mentioned above, pogo pins 212 operate to contact the appropriate electrical contacts in the 3-in-1 connector 208 to the proper test fixture contact to perform testing operations, and SSW operations. The number of pogo pins 212 illustrated in FIG. 11 is for the purposes of illustration only, and a test rack slot 200 may contain any number of pogo pins 212, including more or fewer pogo pins 212 than are illustrated in FIG. 118. The test rack slot 200 is configured such that, when a disk drive 204 is aligned and fully inserted into the slot 200, the pogo pins 212 contact the appropriate electrical contacts within the 3-in-1 connector 208. The disk drive 204 has a connection for an external power supply for enabling SSW operations for more than one head on the disk drive 204. Thus, in this embodiment, the disk drive 204 is inserted into the test rack slot 200 and SSW operations, as well as other diagnostic and testing operations, may be performed.

While the invention has been described in reference to a disk drive, it also has applicability to other electronic devices which may have additional or different power requirements during manufacturing than required for normal customer use. For example, a cellular telephone or personal digital assistant may have an operating system programmed into a programmable read only memory. When programming the programmable read only memory, a voltage higher than required for customer use may be beneficial for manufacturing efficiency. In such a situation, a connection as described herein may be utilized to help prevent inadvertent contact between incompatible electronic contacts.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. For example, the invention is described above in relation to hard disk drives, although the invention is also applicable to any application in which an electrical contact may be required for manufacturing purposes, but which is not needed by the device at the customer for normal device operation. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An electrical interface for a hard disk drive, comprising:

a plurality of contacts, including a first contact, said plurality of contacts adapted to electrically engage with a first connector and one or more other connectors; and a non-conductive restricting member associated with said first contact and being different from the first connector;

wherein said non-conductive restricting member is adapted to electrically insulate at least a substantial portion of only said first contact such that an electrical connection between said first contact and the first connector is allowed while avoiding an electrical connection between said first contact and said one or more other connectors and permitting an electrical connection between the remaining plurality of contacts and said one or more other connectors.

2. An electrical interface for a hard disk drive, as claimed in claim 1, wherein said plurality of contacts includes a set of power contacts, a set of jumper contacts, and a set of logic contacts.

3. An electrical interface for a hard disk drive, as claimed in claim 2, wherein said set of jumper contacts includes said first contact.

4. An electrical interface for a hard disk drive, as claimed in claim 1, wherein said restricting member comprises a shroud.

5. An electrical interface for a hard disk drive, as claimed in claim 4, wherein said shroud includes an access passage operable to allow an electrical connection between said first contact and said first connector.

6. An electrical interface for a hard disk drive, as claimed in claim 1, wherein said first connector is associated with a test rack.

7. An electrical interface for a hard disk drive, as claimed in claim 6, wherein said first connector includes a pogo pin which is operable to contact said first contact.

8. An electrical interface for a hard disk drive, as claimed in claim 1, wherein said second connector is a shorting jumper.

9. An electrical interface for a hard disk drive, as claimed in claim 1, wherein said restricting member is integrated into a 3-in-1 connector associated with said electrical interface.

10. An electrical interface for a hard disk drive, as claimed in claim 1, wherein said restricting member is integrated into an advanced technology attachment (ATA) connector associated with said electrical interface.

11. A method for restricting access to an electrical contact associated with a hard disk drive, comprising:

providing a disk drive with an electrical interface portion having a plurality of contacts, including a first contact;

providing a first connector and a second connector, each of said first and second connectors adapted to engage with said electrical interface portion including the first contact; and in the absence of an electrical connector restricting an electrical connection only to said first contact such that an electrical connection is avoided between said first contact and said first connector while permitting an electrical connection between said first contact and said second connector.

12. A method for restricting access to an electrical contact associated with a hard disk drive, as claimed in claim 11, wherein said restricting step includes:

insulating at least a substantial portion of said first contact such that an electrical contact between said first contact and said second connector is allowed and said first connector is not operable to electrically connect to said first contact.

13. A method for restricting access to an electrical contact associated with a hard disk drive, as claimed in claim 11, wherein said first connector is a shorting jumper and said second connector is associated with a test rack.

14. A method for restricting access to an electrical contact associated with a hard disk drive, as claimed in claim 13, wherein said second connector includes a pogo pin contact.

15. A hard disk drive comprising:

a storage portion;

an electronic control portion operable to control storage of information on said storage portion and retrieval of stored information from said storage portion;

a connector plate electrically coupled to said electronic control portion, having a plurality of electrical contacts; and a shroud associated with said connector plate consisting of an non-conductive pin restriction portion integrated into said shroud and adapted to partially restrict electrical access to a single electrical contact included in said plurality of electrical contacts.

16. A hard disk drive, as claimed in claim 15, wherein said plurality of electrical contacts includes a set of power contacts, a set of jumper contacts, and a set of logic contacts.

17. A hard disk drive, as claimed in claim 16, wherein said set of jumper contacts includes said first electrical contact.

18. A hard disk drive, as claimed in claim 15, wherein said pin restriction portion prevents a shorting jumper from being placed on said first electrical contact.

19. A hard disk drive, as claimed in claim 15, wherein said plurality of electrical contacts comprise a plurality of connector pins.

20. An electrical interface for a hard disk drive for electrically connecting at least one external device to the components within the disk drive, comprising:

electrical contact means for electrically connecting components within the disk drive to at least one external device;

non-conductive restriction means integrated into said electrical contact means for preventing electrical access to a single contact within said electrical contact means by an external connecting means without said restriction means engaging said single contact.

21. An electrical interface for a hard disk drive, as claimed in claim 20, wherein the external connecting means is a shorting jumper.

22. An electrical interface for a hard disk drive, as claimed in claim 20, wherein said electrical contact means includes set of power contacts, a set of jumper contacts, and a set of logic contacts.

23. An electrical interface for a hard disk drive, as claimed in claim 22, wherein said set of jumper contacts includes a self servo write contact.

24. An electrical interface for a bard disk drive, as claimed in claim 23, wherein said restriction means is a shroud.

25. An electrical interface for a hard disk drive, as claimed in claim 24, wherein said shroud includes an access passage operable to allow an electrical connection between said self servo write contact and an external test fixture contact.

26. An electrical interface for a hard disk drive, as claimed in claim 25, wherein the test fixture contact includes a pogo pin, said access passage permits contact between said self servo write contact and the pogo pin.

27. In a hard disk drive having an electrical interface disposed along one edge, the interface comprising a plurality of power contacts for connecting to a power source, a plurality of jumper contacts for connecting to components of the hard disk drive including a transducer for reading from and writing to a hard disk and for connecting to an external power source used in association with self servo writing, and a plurality of logic contacts which are operable to transmit data to and from a hard disk for storage and retrieval, the improvement comprising:

a non-conductive restrictor integrated into said electrical interface for restricting electrical access to at least a substantial portion of only one jumper contact without contacting said only one jumper.

28. A hard disk drive, as claimed in claim 27, wherein said restrictor comprises a shroud.

29. A hard disk drive, as claimed in claim 27, wherein said at least one jumper contact includes a contact for connecting to said external power source used in association with self servo writing.

30. A hard disk drive, comprising:

at least one hard disk having a storage portion;

an electronic control portion operable to control storage of information on said storage portion and retrieval of stored information from said storage portion;

a connector plate electrically coupled to said electronic control portion, having a plurality of connector pins including at least one pin for connecting to a power source, at least one pin for connecting a computer to at least one other component of the disk drive, at least one pin for connecting to an external device for purposes of self servo track writing, and at least one pin for writing data to and retrieving data from said storage portion; and a non-conductive restricting member integrated into said connector plate and associated with said connector plate, said restricting member adapted to restrict electrical access to a selected one of said at least one pin for connecting to an external device for purposes of self servo track writing without said restricting member contacting said selected one of said at least one pin.

31. A hard disk drive, as claimed in claim 30, wherein said restricting member prevents a shorting jumper from being placed on said at least one pin for connecting to an external device for purposes of self servo track writing.

32. A hard disk drive, as claimed in claim 30, wherein said restricting member is a shroud.

33. A hard disk drive, as claimed in claim 32, wherein said shroud includes an access passage operable to allow an electrical connection between a test fixture contact and said at least one pin for connecting to an external device for purposes of self servo track writing.

34. A hard disk drive, as claimed in claim 33, wherein said test fixture contact includes a pogo pin which is operable to contact said at least one pin for connecting to an external device for purposes of self servo track writing.

35. An electrical interface for an electronic component, comprising:

a plurality of contacts, including a first contact and one or more other contacts adjacent to said first contact, at least some of said plurality of contacts including said first contact adapted to electrically engage with a first connector and at least a second connector; and a non-conductive restricting member associated with said first contact and adapted to electrically insulate at least a substantial portion of said first contact;

wherein an electrical connection between said first contact and the first connector is allowed while avoiding an electrical connection between said first contact and said at least second connector;

wherein said first connector is adapted to simultaneously engage at least two contacts, and the second connector is adapted to engage a single contact.

36. An electrical interface for an electronic component, as claimed in claim 35, wherein said restricting member includes a shroud.

37. An electrical interface for an electronic component, as claimed in claim 35, wherein said restricting member permits an electrical connection between said second contact and the second connector.

38. A method for restricting access to an electrical contact associated with a hard disk drive, comprising:

providing a disk drive with an electrical interface portion having a plurality of contacts, including a first contact;

providing a first connector adapted to simultaneously engage at least two of said plurality of contacts including said first contact, and a second connector adapted to engage only a single contact of said plurality of contacts; and providing a non-conductive restrictor, different from said first and second connectors, to preclude an electrical connection between said first connector and only said first contact while allowing an electrical connection between said first contact and said second connector;

wherein said second connector includes a pogo pin contact.

39. A method for restricting access to an electrical contact associated with a hard disk drive, as claimed in claim 38, wherein said restricting step includes:

insulating at least a substantial portion of said first contact such that an electrical contact between said first contact and said second connector is allowed and said first connector is not operable to electrically connect to said first contact.

40. A method for restricting access to an electrical contact associated with a hard disk drive, as claimed in claim 38, wherein said first connector is a shorting jumper and said second connector is associated with a test rack.

41. In combination, a hard disk drive including a connector plate having a plurality of connector pins extending outwardly from said connector plate, a wail integral with and extending outwardly from said connector plate and positioned adjacent one or more of said plurality of connector pins, a first connector adapted to engage with at least a first connector pin, and a shorting jumper adapted to engage with at least two connector pins, said connector plate comprising an integral non-conductive restriction member operable to restrict electrical access between said shorting jumper and said first connector pin without said restricting member contacting said first connector pin.

42. The combination, as claimed in claim 41, wherein said first connector is adapted to engage a single connector pin.

43. The combination, as claimed in claim 41, wherein said first connector is a pogo pin connector.

44. The combination, as claimed in claim 41, wherein said integral restriction member comprises a member positioned parallel to said connector pins.

45. An electrical interface for a hard disk drive, comprising:

a plurality of uniformly spaced contacts adapted to engage with a first connector and a second connector, the first connector being adapted to provide an electrical connection between at least two of said plurality of uniformly spaced contacts and adapted to simultaneously contact at least two of said plurality of contacts; and a non-conductive restricting member integrated into an advanced technology attachment (ATA) connector associated with said electrical interface, said restricting member associated with a single contact of said plurality of contacts and being adapted to restrict access to said single contact such that the first connector cannot be engaged with said single contact, permit access to the remaining of said plurality of contacts by said first connector, and permit access to said single contact by said second connector.

46. An electrical interface for a hard disk drive, as claimed in claim 45, wherein said first connector is a shorting jumper.

47. An electrical interface for a hard disk drive, as claimed in claim 45, wherein said restricting member is integrated into a 3-in-i connector associated with said electrical interface.

48. An electrical interface for a hard disk drive, as claimed in claim 45, wherein said restricting member comprises a shroud.

49. An electrical interface for a hard disk drive, as, claimed in claim 48, wherein said shroud includes an access passage operable to allow an electrical connection between said single contact and a second connector.

50. An electrical interface for a hard disk drive, as claimed in claim 49, wherein said second connector is associated with a test rack.

51. An electrical interface for a hard disk drive, as claimed in claim 50, wherein said second connector includes a pogo pin which is operable to contact said single contact.

52. An electrical interface for a hard disk drive, comprising:

a plurality of pins adapted to engage a first connector, extending in a perpendicular direction from a base of said electrical interface;

a wall at least partially surrounding said plurality of pins, said wall extending from said base in a direction parallel to said plurality of pins; and a non-conductive restricting member integral with said base and extending from said base in a direction parallel to said plurality of pins and adapted to restrict electrical access only to a single pin of said plurality of pins such that a shorting jumper cannot engage said single pin and to allow access to said single pin by said first connector.

53. An electrical interface for a hard disk drive, as claimed in claim 52, wherein said restricting member is integral with said wall.

54. An electrical interface for a hard disk drive, as claimed in claim 52, wherein said restricting member is integrated into a 3-in-i connector associated with said electrical interface.

55. An electrical interface for a hard disk drive, as claimed in claim 52, wherein said restricting member is integrated into an advanced technology attachment (ATA) connector associated with said electrical interface.

56. An electrical interface for a hard disk drive, as claimed in claim 52, wherein said first connector is associated with a test rack.

57. An electrical interface for a hard disk drive, as claimed in claim 56, wherein said first connector includes a pogo pin which is operable to contact said single pin.

* * * * *